United States Patent [19]

DeCristofaro

[11] 4,310,381

[45] Jan. 12, 1982

[54] METHOD FOR IMPROVING MAGNETIC PROPERTIES OF METALLIC GLASS RIBBON

[75] Inventor: Nicholas J. DeCristofaro, Chatham, N.J.

[73] Assignee: Allied Corporation, Morris Township, Morris County, N.J.

[21] Appl. No.: 137,344

[22] Filed: Apr. 4, 1980

[51] Int. Cl.[3] ..... B22D 27/00; C23F 1/00

[52] U.S. Cl. ..... 156/664; 148/121; 164/69.1

[58] Field of Search ..... 156/664; 164/64, 65, 164/69; 148/100, 121; 29/527.6; 204/129.43

[56] References Cited

U.S. PATENT DOCUMENTS

| | | | |
|---|---|---|---|
| 1,998,840 | 4/1935 | Legg et al. | 148/100 |
| 3,607,462 | 9/1971 | Laing | 156/664 |
| 3,870,574 | 3/1975 | Stefan et al. | 148/121 |
| 4,154,283 | 5/1979 | Ray et al. | 164/64 |

FOREIGN PATENT DOCUMENTS

| | | | |
|---|---|---|---|
| 2076195 | 10/1971 | France | 156/664 |
| 574779 | 10/1977 | U.S.S.R. | 156/664 |

OTHER PUBLICATIONS

Varich et al., "Metastable . . . Cooling" Translation from F.M.M., vol. 33, No. 2, (Feb. 1972), pp. 106–109.

*Primary Examiner*—Jerome W. Massie

*Attorney, Agent, or Firm*—James Riesenfeld; Gerhard H. Fuchs

[57] ABSTRACT

The soft magnetic properties of metallic glass ribbon are improved by removing at least a part of the surface before annealing. The magnetic alloy ribbon is prepared by chill block casting, after which the regions of the ribbon surface that adjoined but did not contact the chill block are removed. After being wound into a toroidal core and annealed, the material shows lower coercive force and core loss and higher remanence as compared with material from whose surface the out-of-contact regions were not removed.

6 Claims, 2 Drawing Figures

METHOD FOR IMPROVING MAGNETIC PROPERTIES OF METALLIC GLASS RIBBON

DESCRIPTION

BACKGROUND OF THE INVENTION

1. Field of the Invention

The present invention relates to a method for improving the magnetic properties of metallic glass ribbon, particularly by removing a portion of the ribbon surface prior to magnetic annealing.

2. Description of the Prior Art

For purpose of the present invention, a ribbon is a slender body of substantially rectangular cross section whose transverse dimensions are much smaller than its length.

Continuous ribbon of metallic glass can be formed by impinging a molten stream of certain metal alloys onto a rapidly moving chill block; for example, a rapidly rotating, water-cooled wheel. The molten metal is quenched rapidly into a glassy state on the chill surface. Before it solidifies, however, air may be trapped between the molten metal and the chill block surface. This trapped air results in some regions of the ribbon surface that adjoins the chill surface being quenched while out of contact with the chill surface. For convenience, this surface of the ribbon is hereafter called the "bottom" surface. Although out-of-contact quenching can be mitigated by casting under a vacuum (see e.g., U.S. Pat. No. 4,154,283, issued May 15, 1979, to R. Ray et al.), casting in air is more convenient.

After solidifying on the chill surface, resulting ribbon is either thermally or mechanically bonded to the surface. It must be stripped off to effect a continuous cast. Generally, the stripping process produces on the chill surface a plastically deformed track, whose roughness increases with progressive casting. Because of surface tension in the molten metal, as chill surface roughness increases, an increasing fraction of the ribbon is quenched out of contact with the chill surface.

When ferromagnetic metallic glasses are cast, the progressive increase in chill surface roughness may be accompanied by a deterioration in magnetic properties of the ribbon (after magnetic annealing). These properties include D.C. coercive force, $H_c$; remanence, $B_0$; low-field (80 A/m) magnetization, $B_{80}$; 60 Hz core loss and VA demand of toroidally wound cores. Beginning-of-run samples (produced on a relatively smooth chill surface) experience substantial improvement in all magnetic properties with magnetic annealing; end-of-run samples, produced on an eroded surface, show minimal improvement at best when annealed.

Removing a surface layer—for example, by chemical etching—to produce magnetic material of improved magnetic properties is disclosed in U.S. Pat. No. 1,998,840, issued Apr. 23, 1935, to V. E. Legg et al. That patent relates to crystalline materials that are first heat treated, and it generally involves removing from the surface more than 50 μm ("2 mils").

Electrolytic etching of a magnetic thin film is disclosed in U.S. Pat. No. 3,575,825, issued Apr. 20, 1971, to R. E. Skoda. In that case, removing part of the film surface results in an increase in $H_c$.

SUMMARY OF THE INVENTION

This invention provides a method for improving the magnetic properties of chill-block-cast ferromagnetic metallic glass ribbon by substantially removing, prior to annealing, the regions of the ribbon surface that adjoined, but did not contact, the chill block during quenching. By this method, ribbon may be prepared which may be wound into toroidal cores that have better magnetic properties than cores of ribbon from whose surface these regions were not removed. The improved properties include lower values of $H_c$, 60 Hz core loss, and VA demand and higher values of $B_0$ and $B_{80}$.

Of primary interest in this invention are "soft" magnetic materials, by which is meant those with low values of $H_c$, as opposed to "hard" magnetic materials, which have high $H_c$.

DETAILED DESCRIPTION OF THE INVENTION

Figure 1:
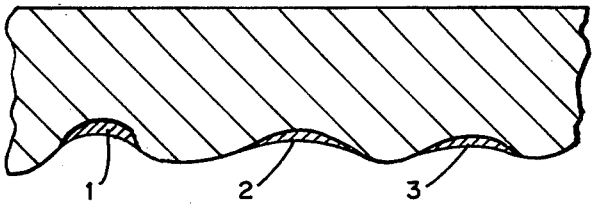
FIG. 1 is a schematic of a cross section through the thickness of a ribbon before treatment by the method of this invention.

The method of this invention permits preparation of ferromagnetic metallic glass ribbon having improved soft magnetic properties. The method comprises removing before annealing that part of the ribbon surface that was adjoining but not in contact with the chill surface during quenching.

Casting of metallic glass ribbon is accomplished by quenching of certain molten alloys at a rate of at least about $10^4$° C./s. These high quench rates may be achieved by the methods of "chill block casting," which have been described by S. Kavesh in Metallic Glasses (Am. Soc. for Metals, 1978), pp. 36–73; by M. C. Narasimhan in U.S. Pat. No. 4,142,571, issued Mar. 6, 1979; and by R. Ray et al. in U.S. Pat. No. 4,154,283, issued May 15, 1979. In the chill block casting process, a jet of molten metal alloy is impinged onto a rapidly moving chill surface. The chill surface may be a moving belt or the inside or outside of a rotating wheel. Attenuation of the molten stream and solidification on the chill surface yield a glassy ribbon, provided the quench rate is high enough for that alloy composition. Low quench rates result in polycrystalline ribbon. Intermediate quench rates may yield glassy ribbon of inferior quality.

As was discussed earlier, out-of-contact-quenched regions on the bottom surface of the solidifying ribbon result when air is trapped under the molten metal and/or when chill block surface roughness and molten metal surface tension combine to produce gaps. Gaps between solidifying ribbon and chill surfaces are more prevalent when the molten metal stream impinges on the chill surface with less force and when the stream is wider, other parameters being equal. Both these characteristics, which are desirable for other ribbon properties, typify planer flow casting, described in the above-mentioned U.S. Pat. No. 4,142,571.

When metallic glass ribbon of a ferromagnetic alloy is cast, the ribbon may be toroidally wound for use as a transformer core. A long continuous ribbon is spirally wound onto a core support, encased in a protective medium and provided with magnetizing wires. Prior to use as a magnetic core, however, it is desirable to process the ribbon to improve certain magnetic properties. As is well-known, such processes include heat treating with or without an externally applied magnetic field. As described in Metal Progress, pp. 84–89 (August 1957), magnetic annealing can result in a change in $H_c$, permeability (B/H ratio) or energy product (B×H), depending on composition and initial magnetic properties. The improvement appears to arise from the fact that most ferromagnetic alloys are magnetostrictive; that is, there magnetic properties are altered as a result of an applied stress. Rapid quenching associated with the preparation of metallic glass tends to produce nonuniform stresses in as-quenched ribbon of the alloys. Heat treating apparently tends to relieve these stresses and results in an increase in the maximum permeability.

Heat treating to improve magnetic properties requires consideration of several parameters, including temperature of heat treatment, time of heat treatment, rate of cooling to room temperature and magnitude and direction of applied magnetic field, if any. Some of these considerations are especially critical when dealing with magnetic glasses. For example, magnetic glasses, which are highly ductile when formed, devitrify at some temperature, which varies with composition, to form a crystalline product that is often brittle. Further, other properties, such as magnetic properties, may also be deleteriously affected by such devitrification. At the same time, however, the temperature of heat treatment must be such as to provide sufficient atomic mobility in the alloy for the release of stresses within a reasonable length of time. Further, for magnetic annealing of magnetic alloys, the temperature of heat treatment must exceed the Curie temperature of the alloy in order to realize substantial improvement in magnetic properties. If annealing is done in an applied magnetic field, the domain walls may be aligned parallel to the length of the ribbon. Additional details concerning magnetic annealing of metallic glasses appear in U.S. Pat. No. 4,081,298, issued Mar. 28, 1978, to Mendelsohn et al.

Ribbon that includes out-of-contact-quenched regions has higher $H_c$ and lower $B_0$ than does ribbon free of such regions. This may be because these regions are magnetically hard and impede domain wall motion in the bulk of the ribbon. Removal of these regions improves the soft magnetic properties of the ribbon. Since annealing causes embrittlement of the ribbon, removal of the slow-quenched regions is preferably accomplished prior thereto.

In principle, the magnetically hard regions of the ribbon surface may be removed by mechanical means, such as abrading. In practice, this means is not preferred for at least two reasons. First, the regions are generally depressed; thus, if abrasion causes the ribbon to acquire a uniform thickness, these regions would not be the first to be removed. Abrasion could thus cause an increase, at least initially, in the percentage of magnetically hard material. Secondly, frictional heating accompanying abrasion could cause embrittlement and other deleterious changes in ribbon properties.

A preferred means of practicing the present invention is by contacting at least the bottom surface of the ribbon with a chemical etchant liquid; for example, a dilute nitric acid-based etchant. Suitable etchants include those commonly used in the study of silicon steels, such as nital (3 to 10% nitric acid in methanol), picral (4% picric acid in ethanol) and other etchants well known in the art. Several suitable etchants and procedures for metallographic use are described in "Metallographic Technique For Magnetic Materials", *Metals Handbook*, 8th ed., vol. 7, ed. by T. Lyman (ASM, Ohio, 1971) pp. 112–114. Among these, a preferred etchant for $Fe_{82}B_{12}Si_6$ comprises a solution of ferric chloride and ammonium bisulfate in dilute nitric acid.

Preferred etchant compositions and conditions depend on alloy composition, thickness and casting conditions. The greater the amount of magnetically hard material on the ribbon surface, the more material must be removed to achieve optimum soft magnetic properties. The optimum amount to be removed in a particular situation can be determined by routine experimentation. Generally, at least about 1% of the bottom surface should be removed, preferably at least about 5%. Removal of material from the top surface of the ribbon results in no improvement in magnetic properties. Nevertheless, since removal of this material generally causes no deterioration of magnetic properties, for convenience, material may be removed from both ribbon surfaces it desirable. For example, ribbon may simply be run through an etchant bath as part of the production process.

The mechanism by which the method of this invention improves the soft magnetic properties of metallic glass ribbon is not yet understood. Nevertheless, without being bound by any theory, I propose the following as a plausible explanation of my results. Where there are gaps between the molten alloy and the chill surface during casting, ribbon oxidation may cause out-of-contact regions of the bottom surface of the ribbon to have different alloy composition from that of the bulk of the ribbon. Quench rates adequate to produce good quality metallic glass ribbon having the bulk composition may yield poor quality (i.e., magnetically hard) glassy or crystalline material of the different composition that characterizes the out-of-contact regions.

Evidence that the elemental composition of out-of-contact-quenched regions may be different from that of the bulk ribbon is provided by Auger analysis and ion etching of a $Fe_{82}B_{12}Si_6$ glassy ribbon. Analysis of 40 μm thick ribbon showed the surface of out-of-contact-quenched regions to be boron-depleted, with boron concentration increasing with depth below the surface and reaching bulk concentration at depths of about 0.2 μm. Although bulk elemental composition prevailed after only 0.5% of the thickness was removed, a much higher percentage of material (~5% by weight) had to be removed to achieve optimum magnetic properties, which suggests that elemental composition doesn't completely determine magnetic properties.

Out-of-contact-quenched regions also seem to be at least partly crystalline, evidenced by different etching behavior in these regions and elsewhere. Etched ribbon shows crystallographic pitting in out-of-contact-quenched regions, but little or no pitting outside these regions. This suggests that crystalline areas are being etched and that the etch rate is different for crystalline and glassy areas.

The method of this invention is suitable for use generally with soft magnetic metallic glass characterized by the formula $$M_aY_b$$

wherein M is a metal selected from the group consisting of iron, nickel and cobalt and mixtures thereof; Y is an element selected from the group consisting of phosphorus, boron, carbon, aluminum, molybdenum and silicon and mixtures thereof; a and b are atomic percent and range from about 70 to 90 and from about 10 to 30, respectively, and the sum of a and b is 100. As soft magnetic materials, iron-based alloys generally have the advantages of high remanence and high permeability; nickel based alloys generally have the advantage of forming glassy structures at lower quench rates. Examples of suitable alloys include $Fe_{82}B_{12}Si_6$, $Fe_{81}B_{13.5}C_2Si_{3.5}$ and $Fe_{39}Ni_{39}B_{18}Mo_4$.

FIG. 1 shows an idealized sectional view of metallic glass ribbon prepared by chill block casting. The bottom surface, which adjoined the chill surface during casting, includes recessed regions 1, 2 and 3. These recessed regions were out of contact with the chill surface as the ribbon was quenched and, as a result, are magnetically hard. The method of this invention comprises substantially removing these out-of-contact-quenched regions prior to magnetic annealing.

Figure 2:
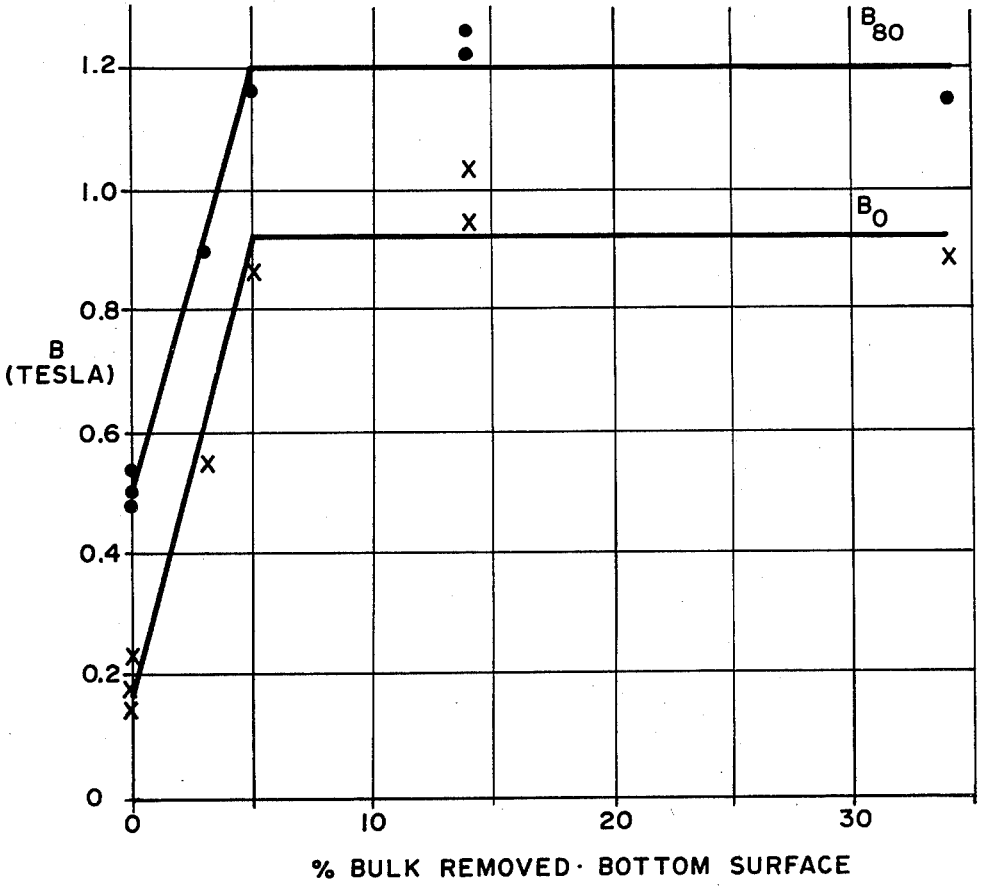
FIG. 2 is a graph of $B_0$ and $B_{80}$ of an annealed toroid as a function of the percent material removed from the surface that adjoined the chill surface.

FIG. 2 shows the improvement in magnetic properties (after annealing) as a function of the weight percentage of material removed by chemical etching of the bottom surface of $Fe_{82}B_{12}Si_6$ glassy ribbon. It is seen that little or no improvement results in that case when more than about 5% is removed.

The following examples illustrate the principle and practice of the present invention. The specific techniques, conditions, materials and reported data are exemplary and should not be construed as limiting the scope of the invention.

EXAMPLE 1

Metallic glass ribbon of composition $Fe_{82}B_{12}Si_6$ was cast on a copper wheel by the planar flow casting technique. Ribbon was 2.5 cm wide and 40 μm thick. Samples from the end of the run; i.e., after about 2000 m had been cast, were first given a protective coating on either the bottom (wheel contact) or top side and then immersed in an etchant prepared from 300 g $Fe_3Cl$, 5 g $NH_4HSO_4$, 300 mL HCl, 75 mL $HNO_3$ and 825 mL $H_2O$ at 55° C. The protective coating insured that the etchant contacted only one surface. Control samples were not immersed in the etchant. The other samples were immersed for 5 seconds (3% reduction in weight), after which they were rinsed, dried and wound into a toroidal core. They were then annealed for 2 hrs. at 340° C. in an applied field of 10 Oe in an argon atmosphere. DC magnetic properties were measured both before and after annealing.

The Table summarizes the results and shows that the soft magnetic properties of the sample whose bottom surface was etched were substantially better after annealing than were those of the controls and the sample whose top surface was etched.

TABLE

| | Magnetic Properties | Un-Treated Control 1 | Un-treated Control 2 | Top Surface Etched (3% removed) | Bottom Surface Etched (3% removed) |
|---|---|---|---|---|---|
| AS-CAST | | | | | |
| | $H_c$(A/m) | 15.2 | 16.8 | 20.0 | 17.6 |
| | $B_o$(T) | 0.36 | 0.35 | 0.35 | 0.36 |
| | $B_{80}$(T) | 0.49 | 0.46 | 0.46 | 0.48 |
| MAGNETIC ANNEALED | | | | | |
| | $H_c$(A/m) | 11.2 | 9.6 | 11.2 | 8.8 |
| | $B_o$(T) | 0.15 | 0.18 | 0.23 | 0.55 |
| | $B_{80}$(T) | 0.43 | 0.50 | 0.50 | 0.90 |

EXAMPLE 2

The procedure of Example 1 was followed, except that a variety of samples had their bottom surface etched for varying lengths of time between 5 and 30 seconds (3 to 34% weight reduction). The post-anneal magnetization as a function of percent of material removed is plotted in FIG. 2.

I claim:

1. A method for improving the magnetic properties of chill-block-cast, ferromagnetic metallic glass ribbon comprising substantially removing, prior to annealing, the regions of the ribbon surface that adjoined, but did not contact, the chill block during quenching.

2. The method of claim 1 in which at least about 1% by weight of ribbon is removed.

3. The method of claim 2 in which at least about 5% by weight of ribbon is removed.

4. The method of claim 1 in which the removal is accomplished by contacting at least the bottom surface of the ribbon with a chemical etchant liquid.

5. The method of claim 4 in which the etchant comprises a dilute nitric acid solution.

6. The method of claim 5 in which the etchant comprises a solution of ferric chloride and ammonium bisulfate in dilute nitric acid.

* * * * *